United States Patent [19]

Kassan

[11] 4,432,548

[45] Feb. 21, 1984

[54] PUZZLE CUBE

[76] Inventor: Peter Kassan, 160 W. 16th St., New York, N.Y. 10011

[21] Appl. No.: 388,081

[22] Filed: Jun. 14, 1982

[51] Int. Cl.[3] ..... A63F 9/08

[52] U.S. Cl. ..... 273/153 S

[58] Field of Search ..... 273/153 S

[56] References Cited

U.S. PATENT DOCUMENTS

| | | | |
|---|---|---|---|
| 427,392 | 5/1890 | Bradshaw | 273/153 S |
| 785,665 | 3/1905 | Coe | 273/153 S |
| 3,845,959 | 11/1974 | Kosarek | 273/153 S |

FOREIGN PATENT DOCUMENTS

| | | | |
|---|---|---|---|
| 2152360 | 4/1973 | Fed. Rep. of Germany | 273/153 S |

OTHER PUBLICATIONS

"Zauber Pyramide" by Tom Werneck, copyright 1981, Published in Austria 1981 by Wilhelm Heyne Verlac, Munich, pp. 176–198.

*Primary Examiner*—Anton O. Oechsle

*Attorney, Agent, or Firm*—Ostrolenk, Faber, Gerb & Soffen

[57] ABSTRACT

A puzzle cube comprising an outer framework and a plurality of small cubes, preferably forming nine squares on each side, wherein the center of the large cube has an open sided cage as a substitute for the 27th cube, said cage being of a size adapted to receive a cube from the center of any of the six sides of the puzzle cube, biasing means for expelling from the cage any cube placed in the cage and an outer frame for retaining all the smaller cubes in larger cubic configuration. The movement of any one of the center small cubes from any side into the cage, prepares the biasing means for expelling the small cube toward that side. The cube thus moved into the cage is retained in position in the cage by the movement of one of the edge cubes into the space previously occupied by the center cube of the side, thereby creating an additional space at the center of an edge and permitting other cubes, such as a corner cube or the center cube of an adjacent face to be moved into said space. A succession of such moves produces a movement of the cubes wherein indicia patterns or colors on the cubes may be arranged in acceptable or predetermined sequence. No internal frame supports the center cubes on any of the sides. No interlocking of the cubes is required.

7 Claims, 10 Drawing Figures

PUZZLE CUBE

The present invention relates to puzzles and, more particularly, to cubic block puzzle in which a large cube is provided with what appears to be 27 smaller cubes, thereby forming the large cube with nine cubes on each side.

The puzzle of the present invention appears to be related to the so-called Rubik puzzle and has an external appearance somewhat similar, except for the central cage which serves to position the cubes and receive one cube at a time, but has an internal structure and method of operation which is entirely different.

The essential element of the present puzzle lies in the fact that the operation thereof is based on a missing small cube which is not readily apparent from examination of the exterior of the structure itself. In some prior devices various mechanical interlocks were arranged so that, for instance, the center cube at any one side always occupied that side and was physically secured to an internal structural element which always secured that central cube in its location. In the present structure, any of the cubes occupying the center position of any edge row may be moved to the center of the side thereby making it possible for one of the corner cubes to be moved to a center position of the row and, thereafter, to be moved again. Through the proper sequence of moves, any cube may be made eventually to occupy any position of the puzzle. However, as in the two-dimensional "15" puzzle, not all arrangements of puzzle elements are attainable from a given starting position.

The essence of the present invention resides in the fact that the central element of the cubic structure is a cage which is capable of receiving any one of the smaller cubes which form the larger cube. The cage thus serves to support all of the smaller cubes in their outer position forming an apparently smooth outer solid surface, while, at the same time, permitting a central cube on any side to be pushed inwardly into the cage and to be retained by the cage on movement of another outer cube over the position initially occupied by the cube which has been pushed thereinto. The cage may be of any construction but is preferably a hollow wire or plastic cage with thin boundaries which will receive any of the outer central cubes on the pushing of such outer central cube thereinto.

The cage, preferably, is slightly larger than any of the cubes to facilitate entry of a cube into the cage. This also requires that the outer framework which contains all of the cubes will be correspondingly slightly larger than an exact multiple of one cube.

While it is preferred that the cage be of relatively strong material, the fact that the cage is supported on all sides by the outer cubes forming the surface of the main cube, means that the cage itself need not be formed of material having extreme or unexpected strength. The cage is used primarily to define the area which in turn is supported by all of the outer cubes and to provide a base or support for the biasing means which will return any outer cube which has been pushed into the central cube.

In addition, the central cage may be supported by extension of selected elements of the wire or other member forming the cage right through to the outer framework. The extension of such elements will, nevertheless, permit the surface cubes to slide within the framework as herein required.

The small cubes are maintained as a large cube with nine square surfaces on each of the six sides by a thin but strong framework which permits the entry of the fingers to move the cubes laterally along the surface and to push any central cube into the main cube body and into the cage. The cage is provided with biasing means, as above pointed out, which may be an elastic element or elements extending over each side of the cage so that when a central cube from any one side is pushed into the cage, it will stretch the elastic band or other biasing element as it is introduced into the cage and, thereby, be biased outwardly.

When a central cube is pushed into the cage, it may be held in the cage against the operation of the biasing means by the movement of another small cube from an edge of the outer surface of the larger cube, that is, the center of the row along each of the edges may provide the cube which is pushed over the original central cube and thereby holds it in place.

Thus, when any central cube is pushed into the cage, any one of four additional cubes on that side from which the first cube has been pushed into the cage, may be moved over the cube which has been pushed into the cage and thereby retain the cube in the cage. Thereafter, any one of the corner cubes may be moved over to fill the space taken by the cube which has been moved over to help retain the initial cube. Thereafter, other cubes may be moved to fill each space that is vacated. At any time when the center of the side from which the small cube has been pushed into the cage is clear of a cube, then the biasing means in the cage will move the cube that was pushed into the cage out to the outer surface again to complete a large cube having apparently 27 smaller cubes, but actually having 26 cubes and the center cage.

Any desired pattern or series of patterns for each side or colors for each of the sides or other pictorial elements or indicia on each of the small cube sides may be used so that they may be arranged and organized in some desired or predetermined regular manner which is achievable by successive movements of the small cubes: successive pushing of the center cube from any selected side into the cage, subsequent movement of other cubes which is made possible by the gap thus created, the expulsion of the cube from the cage when the particular opening from which it has been moved is freed or cleared and the cage then having the ability to take another cube from that same side or any other side.

The essential object of the present invention, therefore, is the arrangement of a puzzle cube having apparently 27 small cubes making up the puzzle cube, providing nine squares on each side in three rows of three squares each, but which nevertheless has only 26 cubes plus a central cage adapted to receive an outer cube which may be pushed thereinto.

A further object of the present invention is a puzzle cube of the type aforesaid, in which the central cage is provided with biasing means such as an elastic band or other means which will serve to expel the cube which has been inserted therein from the side into which it has been inserted.

A further object of the present invention is to provide a framework maintaining all of the smaller cubes in the larger cubic relationship and which will prevent the various small cubes from falling out of the large cubic arrangement.

A further object of the present invention is the provision of a lost cube cubic puzzle wherein one less cube is provided than apparently is used and in which any of the center smaller cubes on each side may be pushed into the central cage to permit other cubes on that side, and even adjacent sides, to be moved with respect to the cubic puzzle as a whole.

A still further object of the present invention is the provision of means cooperating with the cage, the elastic means therein and the smaller cubes to retain all of the cubes in cubic arrangement.

The foregoing and many other objects of the present invention will become apparent in the following description and drawings, in which.

Figure 6:
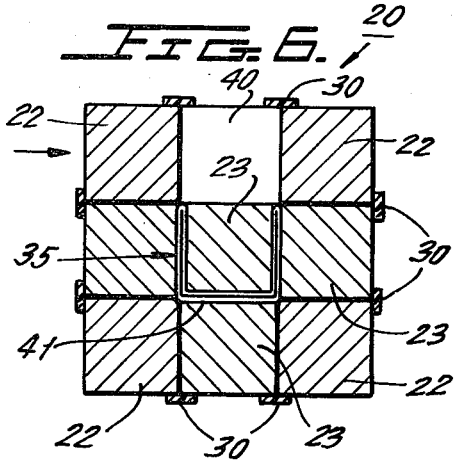
FIG. 6 is a view corresponding to that of FIG. 5 showing the center small cube of one side fully inserted.
Figure 8:
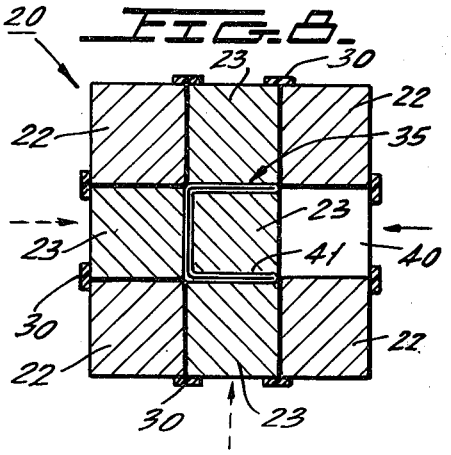
FIG. 8 is a cross-sectional view taken along line 8—8 of FIG. 1 shows a central cube from one side pushed in from a side which is different from that utilized in connection with FIGS. 4 through 7.
Figure 9:
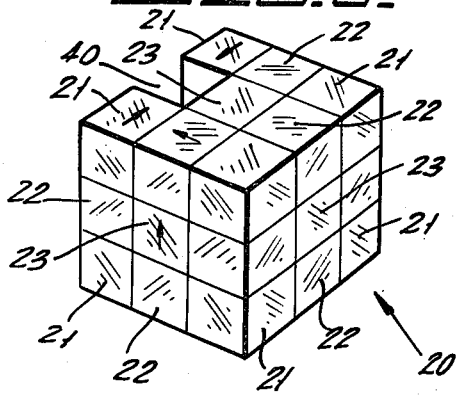
Figure 10:
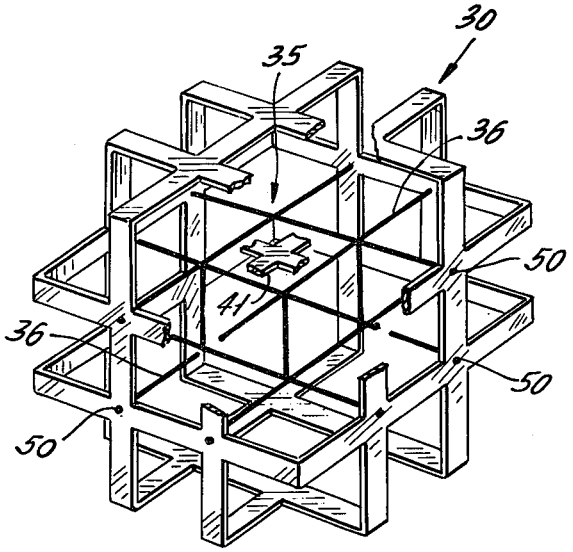

FIG. 9 is a view in perspective corresponding to the condition shown in FIG. 6 wherein one of the edge cubes of the side from which the center cube has been pushed into the cage has been moved over to hold that cube in place against the biasing means of the central cage; and FIG. 10 is a view in perspective showing a modified form of the cage wherein the cage is supported not by the other cubes, but is directly supported to the framework by extensions between which the other cubes may pass.

Referring to the Figures, the puzzle cube 20 of the present invention comprises a plurality of smaller cubes constituting the corner cubes 21, 21, the edges cubes 22, 22 and the central cubes 23, 23. These cubes are maintained in position against falling apart by a permanent outer framework 30 which is so arranged that it provides runs extending along the margins between adjacent cubes and thereby maintains all of the cubes in position.

Figure 3:
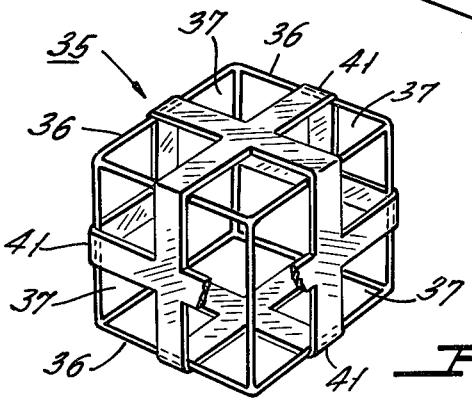
FIG. 3 is a view in perspective of the central cage of the present invention.

The essential element of the present invention, as previously described, is the cage 35 which, as seen in FIG. 3, is a framework formed of tough wire or plastic 36 having openings 37 on each of the six sides. As has already been mentioned, while it is desirable that the cage 35 be strong, it is actually supported in every instance by the other cubes. Even when an outer cube, as hereinafter described, is inserted therein, it is still supported on the outside by five cubes and supported on the inside by the cube which has been inserted therein. Hence, the cage primarily has the function of creating a void at the center of the larger cube 20 and to provide a framework on which the elastic bands 41 may be supported. The elastic bands may be integral, as shown, or constitute a plurality of elastic bands which cover each of the six open sides of the cage.

Figure 5:
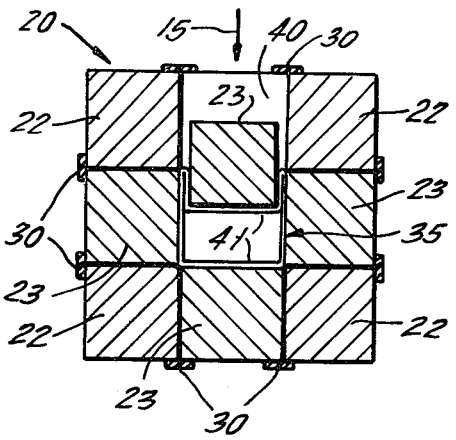
FIG. 5 is a view corresponding to that of FIG. 4 showing a central cube from one side being pushed into the center of the large cube in the direction indicated by the arrow 15 of FIG. 1.
Figure 4:
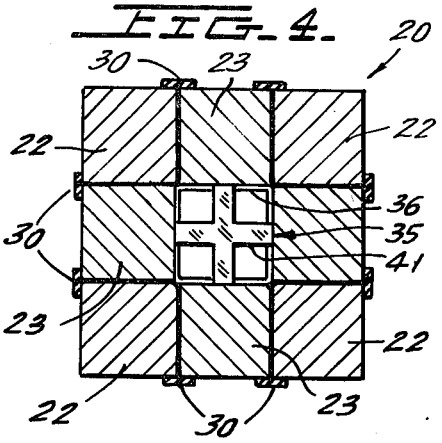
FIG. 4 is a cross-sectional view taken along line 4—4 of FIG. 1 looking in the direction of the arrows.

In operating the cube, one of the center cubes 23 is pushed into the cage in the manner shown in FIGS. 5 and 6, stretching the elastic band 41 on that particular side. Again, it will here be seen, especially from FIGS. 5 and 6, that the cage is supported on five sides by the other cubes which are not pushed thereinto and is supported internally by the cube which has been pushed thereinto.

The cage 35 is so dimensioned that it will readily receive one of the individual cubes, such as the center cube 23. To facilitate entry of the individual cubes, such as cube 20 into the cage 35, the cage 35 may be made slightly larger in dimension than any of the individual cubes 20. It should be noted that since the outer framework 30 supports and contains the cubes and has elements extending along each of the margins between the cubes, the slight spreading of the individual cubes in order to accommodate the central cage which is slightly larger in dimension than the cubes is effectively concealed by the supporting framework.

The advance here gained is ease of manipulation while, nevertheless, presenting the appearance of a compactly arranged structure.

Figure 7:
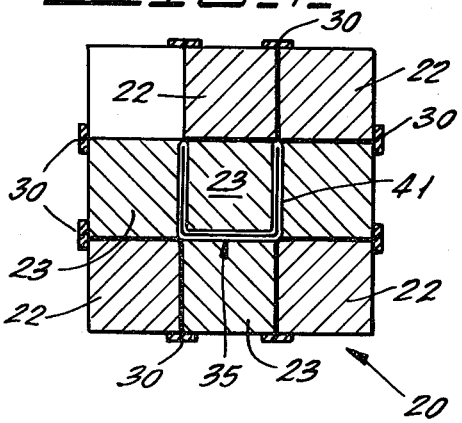
FIG. 7 is a view corresponding to that of FIGS. 5 and 6 showing how one of the central cubes from the same side is moved over the cube which has been inserted in the cage to retain the cube in the cage in conjunction with the framework which supports all of the cubes.

When the center cube 23 on any one side is pushed into the cage, then an edge cube 22 on that side may be slid over the center cube 23 which has been pushed into the cage, as shown for instance in FIG. 7, and thereby in cooperation with the outer framework 30 retain that center cube 23 in position. This provides a vacant space 40 as seen in FIGS. 5, 6 and 9. Thereafter, one of the corner cubes 21 may be pushed into the vacant space 40 providing another vacant space into which one of the edge cubes 22 may be pushed, thereby providing a still further vacant space into which, for instance, one of the center cubes 23 may be pushed. This provides a succession of vacant spaces which may receive any adjacent cubes. However, when a cube is withdrawn from the side and surface over the center cube which has been pushed into the cage, and a vacant space appears above that center cube, as seen in FIG. 6, the elastic structure 41 will serve to drive the center cube out into the center of the side from which it has been pushed.

In addition, the cage may be supported not only by the cubes which surround it, but may be independently supported by the outer framework 30. As shown in FIG. 10, selected wires or edges 36 of the cage may be extended to the outer framework 30. In fact, all 12 such wires may be extended if desired to engagement at 50, 50 with the outer framework 30. As an alternative, a selected pair of wires or four selected wires 36 may thus be extended with the purpose of anchoring the cage at the center of the framework 30 and at the center of the individual cubes 21, 22, 23. This will provide an additional support for the cage serving also to reinforce it, while at the same time permitting the individual cubes 21, 22, 23 to move readily from one position to another between the wire extensions. This is possible because the cage is preferably made slightly larger than a small cube and the wire extensions from the cage would be spaced apart slightly more than the dimension of an individual cube 21, 22, 23 so that they may readily be moved.

By this means, in essence, a lost space cubic puzzle is provided where the lost space is completely concealed, but provides a means for moving a center cube from any of the six sides of the larger cube into this space and thereby freeing other spaces into which cubes may be successively moved.

As long as the area of the center cube of the side from which the small cube has been pushed into the cage is covered by another cube, that center cube will stay in the cage and manipulation of the other cubes of the entire structure into successive empty spaces may occur.

Figure 1:
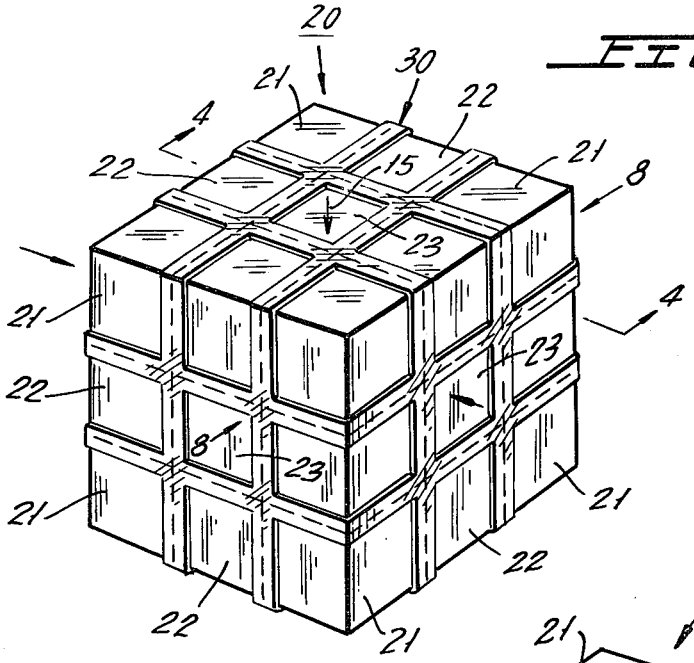
FIG. 1 is a view in perspective of the exterior of the puzzle cube of the present invention.
Figure 2:
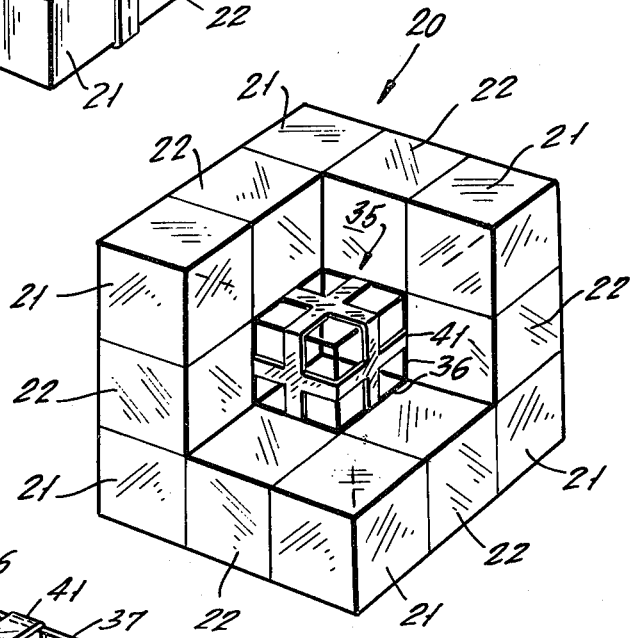
FIG. 2 is a view similar to that of FIG. 1 but broken away to show the central cage and the elastic elements which surround the same in order to form the operating section of the puzzle of the present invention.

When the cube which overlies directly the cube which has been pushed into the cage is moved from the side from which the small cube has been pushed into the cage, then the elastic band will cause that center cube to move outwardly to complete the structure as shown in FIG. 1.

By arranging various indicia, patterns, colors or other elements on each of the cubes, the puzzle operator may be provided with a guide by which he can reconstruct a sequential set of indicia or complete a pattern or have a series of solid colors on each side or a series of patterns including solid colors on each side.

Many types of cubic puzzles have been known and many types of flat puzzles with a missing square are known. In this case, the cubic puzzle depends on a missing central cubic space which can receive and store an outer cube to provide a space for the outer cube elements of the large puzzle cube to be manipulated to form successive spaces and thus to create patterns. And the center cube may then be expelled from the center and returned to the side from which it was first inserted to complete the puzzle and to conceal the fact that there is a lost cube area. In two-dimensional puzzles with a lost square, the lost square is obvious.

In this case, the center cube on each side is movable into the interior cage and may, after manipulation of the small cubes forming the larger cube, be returned to the side from which it has been inserted. Six different cubes may thus be inserted into the cage and successively moved outwardly from the cage providing a successive series of outer cubic spaces into which corner and edge small cubes of the larger cubic puzzle may be moved.

When the elastic bands or biasing means are omitted, then a cube pushed in from one side may later be pushed out to the same or another side when the space to receive it is clear. In such case, it is necessary to push a cube overlying the cube in the cage into the cage to push out the cube already in the cage. Also, in such case, once the smaller cube is pushed into the cage, there will always be a cube missing from one of the sides of the larger cube.

In the foregoing, the present invention has been described solely in connection with a preferred illustrative embodiment thereof. Since many variations and modifications will now be obvious to those skilled in the art, it is preferred that the scope of this invention be determined not by the specific disclosures herein contained but only by the appended claims.

What is claimed is:

1. A puzzle cube comprising a plurality of smaller cubes; the smaller cubes together forming a square having an odd number on each of the sides of the puzzle cube;

a framework containing the smaller cubes in large cubical arrangement, said framework extending along margins between the cubes and permitting the cubes to be manipulated through the framework;

a central cage within said larger cube;

a center cube from at least one of the sides of said puzzle cube, being movable into said central cage and out of said central cage;

said central cage comprising a framework open on each side and into which the central cube forming part of any one side of the larger cube may be moved;

said puzzle cube including biasing means on said central cage, biasing any cube moved thereinto outwardly of said cage.

2. The puzzle cube of claim 1, wherein a small cube adjacent to the central cube on the side from which the cube has been moved into said cage being thereafter movable into the space previously occupied by said small cube which has been moved into the cage, thereby retaining the last mentioned cube in position and providing an additional empty space into which an adjacent cube may be moved.

3. The puzzle cube according to claim 2, wherein the small cubes are successively movable into each space which is formed when a cube is moved to an empty space.

4. The puzzle cube of claim 3, wherein said biasing means restores the smaller cube which has been moved into the cage to the side from which the cube has been inserted when the additional smaller cubes are so arranged that the central space of the side from which the cube has been inserted becomes vacant.

5. The puzzle cube of claim 4, wherein each of the sides of the large puzzle cube consists of nine squares formed by nine cubes and apparently forming a large cube having 27 cubes, but wherein the central cube is replaced by said cage which is open on each side, thereby providing a puzzle cube consisting of 26 smaller cubes and a central cage.

6. The puzzle cube of claim 5, wherein a plurality of patterns, indicia, related objects, designs or colors are provided on the surfaces of the 26 cubes to enable the user to create expected or desired arrangements of the sides of the outer surfaces of the small cubes forming the side of the large cube.

7. The puzzle cube of claim 2, wherein the framework of the central cage comprises a plurality of rigid filaments defining openings into which smaller cubes may be moved, at least two of said filaments having extensions extending to the framework which contains the smaller cubes; said smaller cubes being movable between said extensions when moved parallel to the framework and being movable in a direction parallel to said extensions into said cage when any one of the smaller cubes is positioned over said cage.

* * * * *